US007290623B2

(12) United States Patent
Roussy

(10) Patent No.: US 7,290,623 B2
(45) Date of Patent: Nov. 6, 2007

(54) WELDED JOINTS FOR ROTARY-VIBRATORY DRILLS HAVING REDUCED STRESS

(76) Inventor: Raymond Joseph Roussy, 12491 - 57A Avenue, Surrey, British Columbia (CA) V3X 2S6

( * ) Notice: Subject to any disclaimer, the term of this patent is extended or adjusted under 35 U.S.C. 154(b) by 323 days.

(21) Appl. No.: 10/520,924

(22) PCT Filed: Jul. 10, 2003

(86) PCT No.: PCT/CA03/01049

§ 371 (c)(1),
(2), (4) Date: Jan. 11, 2005

(87) PCT Pub. No.: WO2004/009948

PCT Pub. Date: Jan. 29, 2004

(65) Prior Publication Data

US 2006/0048971 A1 Mar. 9, 2006

(30) Foreign Application Priority Data

Jul. 19, 2002 (CA) ..... 2394488

(51) Int. Cl.
*E21B 17/16* (2006.01)

(52) U.S. Cl. ..... 175/57; 175/320

(58) Field of Classification Search ..... None
See application file for complete search history.

(56) References Cited

U.S. PATENT DOCUMENTS

| | | | |
|---|---|---|---|
| 2,711,912 | A | 6/1955 | Boice |
| 3,521,811 | A | 7/1970 | Bardgette |
| 4,735,444 | A | 4/1988 | Skipper |
| 5,086,854 | A | 2/1992 | Roussy |

*Primary Examiner*—Frank Tsay
(74) *Attorney, Agent, or Firm*—Cameron IP

(57) ABSTRACT

A drill string for a rotary-vibratory drill comprises a plurality of drill pipes. Each of the drill pipes has a longitudinal axis and at least one end. A female connector member and a male connector member are between the ends of adjacent said drill pipes, the female connector member having a first portion mating with a first of the adjacent drill pipes and a second portion extending away from the first of the drill pipes. The male connector member has a first portion mating with a second of the adjacent drill pipes and a second portion extending away from the second of the drill pipes, the second portion of the female connector threadedly engaging the second portion of the male connector. One of said each drill pipe and the connectors has a plurality of spaced-apart slots adjacent to the end of the drill pipe and communicating outwardly at the end. The slots are parallel to the longitudinal axis. Each of the connectors is connected to one of the adjacent drill pipes by welding extending about an adjacent said end of the one drill pipe and along the slots.

18 Claims, 2 Drawing Sheets

To Suit
APPROX 3/8"
1 3/4"
64
58
2.08"
TYP.

WELDED JOINTS FOR ROTARY-VIBRATORY DRILLS HAVING REDUCED STRESS

BACKGROUND OF THE INVENTION

This invention relates to drill pipes for rotary-vibratory drills and, in particular, to joints for the drill pipes.

Rotary-vibratory drills employ a vibratory force superimposed upon a rotary action to accomplish the drilling operation. Sonic drills are rotary-vibratory drills where the vibration is in the sonic range. Sonic drills are used for such applications as drilling through overburden in placer exploration, installing concrete piles, water well drilling, rock drilling for blast holes, for rock coring and for testing soil for levels of contamination.

One of the major problems associated with sonic drilling machines in the past has been the failure to develop suitable drill tooling. Extremely high alternating forces are generated within the drill pipe. Standard drill pipe is designed to withstand the torque developed during rotary drilling, but not the high alternating tensile and compressive loads encountered in sonic drilling. These reversing loads are especially critical at the threaded ends of tool joints because of the stress concentration created by the presence of the threads.

Various approaches to solving the problem of joint failure have been attempted. One was to machine threads directly onto the drill pipe. This was not completely successful because the threads reduced the cross-sectional area of the pipe and simultaneously acted as a point of stress concentration as suggested above.

Another attempt was to use heavy wall pipe. However, it was then realized that the drill pipe stains or elongates and contracts the same amount in resonance regardless of its thickness. The greater cross section simply increases the force which must be transmitted by the joint, leading to failure at the threads.

Next, drill pipe was tested with a relatively thick tool joint in relation to the thickness of the drill pipe. This configuration is routinely used for rotary drills used in drilling oil and water wells. These are generally assembled by circumferential welds between the pipe and threaded connection members used at the joint or by friction welding the members to the pipe. These welds however do not long withstand the fatigue loading conditions and high stress concentrations encountered in sonic drilling.

Pipe joints employing alternating fingers and slots extending circumferentially about the pipe have been used for other purposes such as the oil drilling platform disclosed in U.S. Pat. No. 3,521,811 to Bardgette. However, the problem encountered in that instance is not analogous to the difficulties encountered in sonic drilling and therefore does not suggest a solution to the problem.

The problems were largely overcome by my earlier U.S. Pat. No. 5,086,854 which disclosed a drill string where the drill pipes are welded to threaded connectors along V-shaped slots in the drill pipe. However, although a vast improvement over the prior art, some problems remained. In particular, the life of the drills has been shorter than considered desirable.

Analysis has shown that the problem is caused by the weld puddle at the bottom of the V-shaped slot in the drill pipe. As this weld puddle cools, it shrinks and causes high tensile stresses that this location. When the pipe is then vibrated, cracks form around these weld puddles. Eventually the cracks start to propagate until they meet each other and the pipe fails completely. If this happens in a deep hole, then the length of pipe below the fracture point is lost at considerable expense.

The stress concentration caused by the shrinking weld puddle theoretically could be reduced or eliminated by subjecting the entire length of the pipe to a stress relief procedure. However this is not very practical since stress relief furnaces are usually not long enough. Furthermore, only a few pieces could be done at one time since the rods and casing would go too far out of round unless they are properly supported. Consequently such stress relieving would make the parts too expensive.

Accordingly it is an object of the invention to provide an improved rotary-vibratory drill assembly, drill string and method for connecting drill strings together which offers better durability than earlier such drill assemblies, drill strings and methods.

It is also an object of the invention to provide an improved rotary-vibratory drill assembly, drill string and method for connecting drill strings together which improves the economy of drilling operations compared with earlier drill assemblies, drill strings and methods.

SUMMARY OF THE INVENTION

According to one aspect of the invention there is provided a drill string for a rotary-vibratory drill comprising a plurality of drill pipes. Each of the drill pipes has a longitudinal axis and at least one end. A female connector member and a male connector member are between the ends of adjacent said drill pipes, the female connector member having a first portion which mates with a first of the adjacent drill pipes and a second portion extending away from the first of the drill pipes. The male connector member has a first portion which mates with a second of the adjacent drill pipes and a second portion extending away from the second of the drill pipes, the second portion of the female connector threadedly engaging the second portion of the male connector. One of said each drill pipe and the connectors has a plurality of spaced-apart slots adjacent to the end of the drill pipe and communicating outwardly at the end. The slots are parallel to the longitudinal axis. Each of the connectors is connected to one of the adjacent drill pipes by welding extending about an adjacent said end of the one drill pipe and along the slots.

According to another aspect of the invention there is provided a drill pipe assembly comprising a drill pipe having a longitudinal axis and an end, and a threaded connector member having a first portion which mates with the drill pipe and a second portion extending away from the drill pipe. At least one of the drill pipe and connector member has a plurality of spaced-apart slots adjacent to the end and communicating outwardly at the end. The slots are parallel to the longitudinal axis. The connector is connected to the drill pipe by welding extending about said end of the drill pipe and along the slots.

According to a further aspect of the invention, there is provided a method of connecting a drill pipe for a rotary-vibratory drill to a threaded connector. The drill pipe has a longitudinal axis and an end, the threaded connector member having a first portion which mates with the drill pipe and a second portion extending away from the drill pipe. At least one of the connector member and the drill pipe has a plurality of spaced-apart slots adjacent the end of the drill pipe and communicates outwardly at the end. The slots are parallel to the longitudinal axis. The connector is connected to the drill pipe by welding about said end of the drill pipe and along the slots.

According to a still further aspect of the invention, there is provided a method of connecting a drill pipe for a rotary-vibratory drill to a threaded connector, the drill pipe having a longitudinal axis and an end. The threaded connector member has a first portion which mates within the drill pipe and a second portion extending away from the drill pipe, at least one of the connector member and the drill pipe having a plurality of spaced-apart slots adjacent the end of the drill pipe and communicating outwardly at the end. The connector is connected to the drill pipe by first welding the slots adjacent the end of the drill pipe, peening the welds adjacent to the end of the drill pipe and then welding about said end of the drill pipe and along the slots.

The invention offers significant advantages compared to the prior art. Effectively the life of the drill string is considerably enhanced compared with prior art connection methods. Furthermore, this is done economically compared to alternative measures such as stress relieving. The prospect of losing expensive drills down a drill hole is significantly reduced. At the same time, the structure of the drill assembly is actually simplified compared to some of the prior art.

DESCRIPTION OF THE PREFERRED EMBODIMENTS

Figure 1:
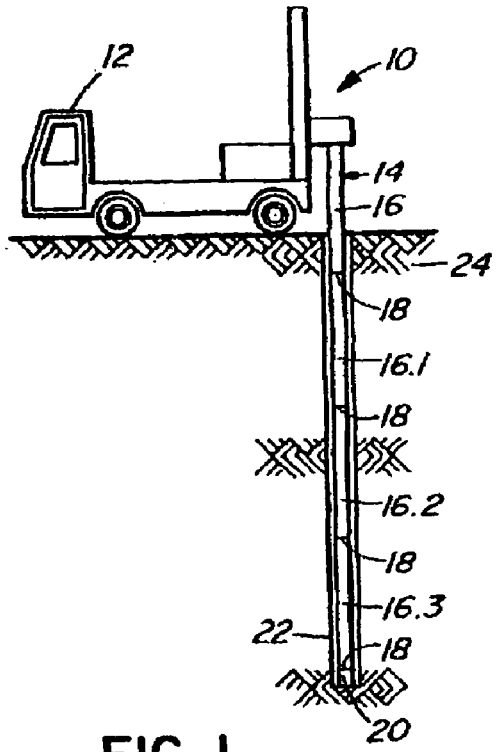
FIG. 1 is a diagrammatic elevation of a sonic drilling rig with the drill shown in position in a drill hole, the drill hole being shown in section.

Referring to the drawings, FIG. 1 shows a sonic drilling rig 10 which, in this example, is mounted on the back of a truck 12. As mentioned above, sonic drills are combination rotary and vibratory drills where the vibrations are in the sonic range. The drilling rig is conventional and therefore is not described in greater detail.

The drilling rig is connected to a drill string 14 which includes a plurality of drill pipe assemblies 16, 16.1, 16.2 and 16.3 with a drilling tool 20 at the bottom end for drilling a drill hole 22 through overburden 24 or some other geological structure. The drill pipe assemblies are connected together at a series of pipe joints 18.

Figure 2:
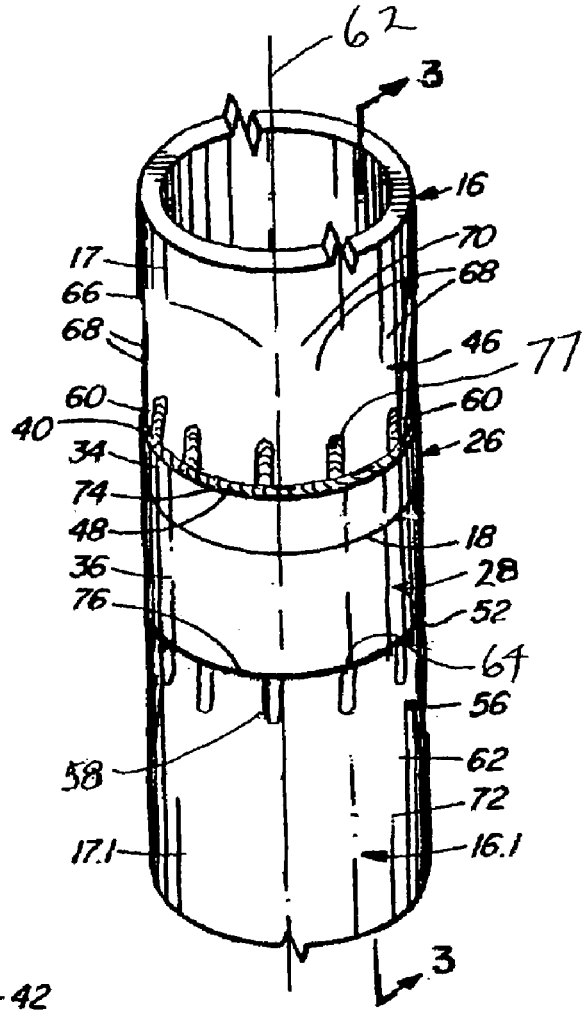
FIG. 2 is an enlarged, fragmentary isometric view of a section of the drill string from FIG. 1 showing one of the joints thereof, the connector member of the lower drill assembly being shown unwelded.
Figure 3:
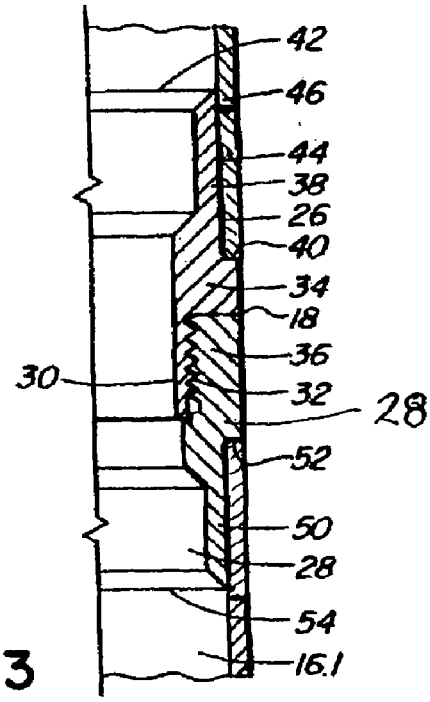
FIG. 3 is a sectional view taken along line 3-3 of FIG. 2.

One of the pipe joints 18 is shown in FIGS. 2 and 3, the others being identical. The joint includes a male threaded connector member 26 which threadedly engages a complementary female threaded connector member 28. As shown best in FIG. 3, the threads 30 of member 26 engage the threads 32 of member 28.

The members 26 and 28 have outer portions 34 and 36 respectively which abut each other at joint 18, the threads 30 and 32 being machined onto the outer portions. Member 26 has an inner portion 38 which extends from shoulder 40 to inner end 42 of the member and mates with the pipe 17 by fitting within the pipe in this example. Each of the pipe assemblies includes a pipe, for example pipes 17 and 17.1 of pipe assemblies 16 and 16.1 respectively. In this example the pipes are of schedule 40, 4 inch pipe, though other available substitutes may be used. The invention also applies to pipe diameters other than 4 inch as used in this example.

The inner portion 38 of connection member 26 has an outside surface 44 with a diameter generally equal to the inside diameter of pipe 17. End portion 46 of the pipe overlaps the inner portion 38 of member 26 and has an end 48, shown in FIG. 2, which abuts the shoulder 40. In this example the pipe 17 and outer portion 34 have equal outer diameters to yield a uniform diameter on the outside of drill string 14.

Member 28 has an inner portion 50 which extends from shoulder 52 to inner end 54 of the member. It has a similar configuration to portion 38 of member 26 and mates with end portion 56 of pipe member 17.1.

In this example the members 26 and 28 are made from alloy steel tubing such as 4130 with a content of: Carbon 0.35%, manganese 1.4%, silicon 0.3%, sulfur 0.05% and phosphorus 0.04%. However other metals and alloys could be substituted.

The members are heat treated and stress relieved before final machining in this preferred example. The inner portions of the members are cooled in dry ice and acetone or the pipe ends are heated to 150° C. to fit the pipes over the inner portions of the connection members during assembly.

Figure 4:
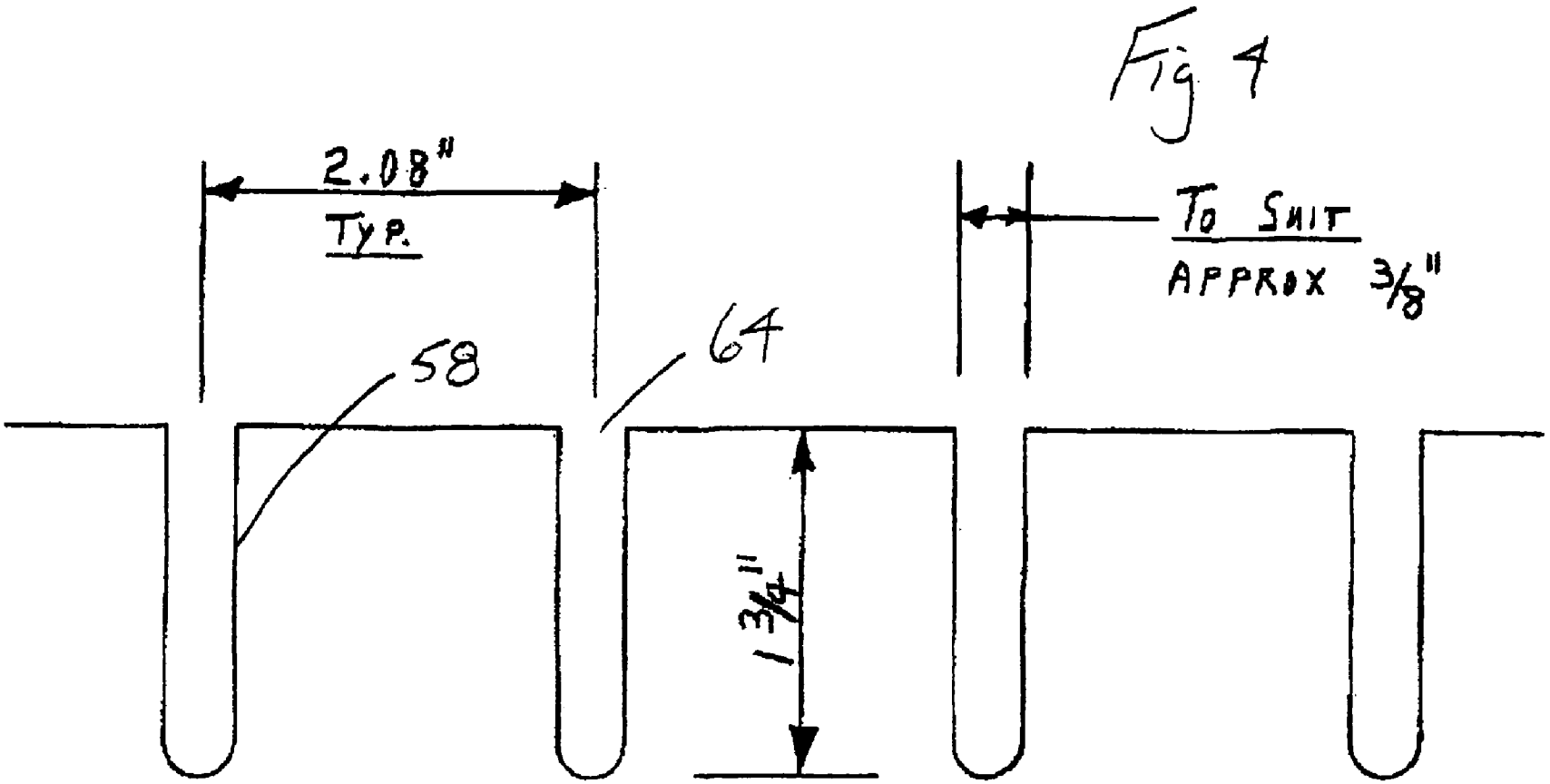
FIG. 4 is an unrolled, elevational view of the slots of one of the drill pipes of FIG. 2.

As seen best in FIG. 2, the end portion 56 of the pipe 17.1 has a plurality of slots 58. Slots 58 have open ends 64, best seen in FIG. 4, adjacent the outer portion 36 of connection member 28. The slots are elongated in the axial direction of pipes 17 and 17.1, that is parallel to their common longitudinal axis 62. In this example there are twelve slots circumferentially spaced-apart about pipe 17.1. It may be seen that the slots are spaced-apart from each other and are U-shaped in this example.

In practice the connection member 28 would be connected to the drill pipe 17.1 by welding along each of the slots 58 and circumferentially about end 76 of pipe 17.1. However the welding is amended for illustrative purposes in FIG. 2 and illustrated instead only for the upper pipe 17 and connector member 26.

Welds 77 extend along each of the slots 58, filling the slots and connecting the pipe 17 to the connector member 26. The welding is initiated by placing welds at the open ends of each of the slots. These welds are then peened. The peening expands the metal which reduces the tensile stress. This allows the drill assemblies to have more slots which can be shorter than found in the prior art. This helps reduce the alternating stresses caused by the oscillations. In effect there are more slots to share the load than the prior art using the V pattern.

As described above, the portion of pipe 17 adjacent end 48 overlaps inner portion 38 of connection member 26. Welds 77 secure the pipe member 17 to the connection member 26. The welds extend along the slots and are aligned with the axial direction of pipe 17.

The end portions of the pipe members and the connection members are preferably pre-heated to a minimum 150° C. according to the conventional procedures for welding alloy steel. The welds 77 are a minimum ¼" in this preferred example and either E7018 low hydrogen rods or flux core wire is employed in welding. The welds are preferably flame stress relieved.

In this embodiment there are also circumferential welds 74 between the end of pipe 17 and outer portion 34 of connection member 26. These connect the welds 77 together. Similar circumferential welds secure pipe 17.1 to connection member 28.

By way of further example, the pipe members could fit within the connection members. In that case the slots would be in the connection members.

It will be understood by someone skilled in the art in many of the details provided above are by way of example only and are not intended to limit scope of the invention which is to be interpreted with reference to the following claims.

What is claimed is:

1. A drill string for a rotary-vibratory drill comprising a plurality of drill pipes, each of the drill pipes having a longitudinal axis and at least one end; a female connector member and a male connector member being between the ends of adjacent said drill pipes, the female connector member having a first portion which mates with a first of the adjacent drill pipes and a second portion extending away from the first of the drill pipes, the male connector member having a first portion which mates with a second of the adjacent drill pipes and a second portion extending away from the second of the drill pipes, the second portion of the female connector threadedly engaging the second portion of the male connector, one of said each drill pipe and the connectors having a plurality of spaced-apart slots adjacent to the end of the drill pipe and communicating outwardly at the end, the slots being parallel to the longitudinal axis, each of the connectors being connected to one of the adjacent drill pipes by welding extending about an adjacent said end of the one drill pipe and along the slots.

2. The drill string as claimed in claim 1, wherein the drill pipes fit over the first portions of the connector members and the slots are in the drill pipes.

3. The drill string as claimed in claim 2, wherein each of the slots has a rounded end spaced-apart from said at least one end of said each drill pipe.

4. The drill string as claimed in claim 2, wherein the welding forms a ring extending completely about said adjacent end of the one drill pipe.

5. The drill string as claimed in claim 2, wherein the slots are U-shaped.

6. A drill pipe assembly comprising a drill pipe having a longitudinal axis and an end, and a threaded connector member having a first portion within the drill pipe and a second portion extending away from the drill pipe, at least one of the drill pipe and connector member having a plurality of spaced-apart slots adjacent to the end and communicating outwardly at the end, the slots being parallel to the longitudinal axis, the connector being connected to the drill pipe by welding extending about said end of the drill pipe and along the slots.

7. The drill pipe assembly as claimed in claim 6, wherein the drill pipe fits over the first portion of the connector member and the slots are in the drill pipe.

8. The drill pipe assembly as claimed in claim 7, wherein each of the slots has a rounded end spaced-apart from said end of said drill pipe.

9. The drill pipe assembly as claimed in claim 7, wherein the welding forms a ring extending completely about said end of the drill pipe.

10. The drill pipe assembly as claimed in claim 7, wherein the slots are U-shaped.

11. A method of connecting a drill pipe for a rotary-vibratory drill to a threaded connector, the drill pipe having a longitudinal axis and an end, the threaded connector member having a first portion mating with the drill pipe and a second portion extending away from the drill pipe, at least one of the connector member and the drill pipe having a plurality of spaced-apart slots adjacent the end of the drill pipe and communicating outwardly at the end, the slots being parallel to the longitudinal axis, the connector being connected to the drill pipe by welding about said end of the drill pipe and along the slots.

12. The method as claimed in claim 11, wherein the drill pipe is fitted over the first portion of the connector member, the slots are in the drill pipe and the welds are extended through the slots to the connector member.

13. The method as claimed in claim 12, wherein the slots have open ends adjacent to die connector member, the welding being carried out by first welding the open ends of the slots.

14. The method as claimed in claim 13, wherein the welded open ends of the slots are peened prior to welding the rest of the slots and welding about the end of the drill pipe.

15. The method as claimed in claim 11, wherein the end of the drill pipe is completely welded to the connector member in a ring.

16. A method of connecting a drill pipe for a rotary-vibratory drill to a threaded connector, the drill pipe having a longitudinal axis and an end, the threaded connector member having a first portion mating with the drill pipe and a second portion extending away from the drill pipe, at least one of the connector member and the drill pipe having a plurality of spaced-apart slots adjacent the end of the drill pipe and communicating outwardly at the end, the slots being parallel to the longitudinal axis, the connector being connected to the drill pipe by first welding the slots adjacent to the end of the drill pipe, peening the welds adjacent to the end of the drill pipe and then welding about said end of the drill pipe and along the slots.

17. The method as claimed in claim 16, wherein the drill pipe is fitted over the first portion of the connector member, the slots are in the drill pipe and the welds are extended through the slots to the connector member.

18. The method as claimed in claim 16, wherein the end of the drill pipe is completely welded to the connector member in a ring.

* * * * *